US011518591B2

(12) United States Patent
Lamoureux

(10) Patent No.: US 11,518,591 B2
(45) Date of Patent: Dec. 6, 2022

(54) STRIP FOR SECURING A STOPPER TO A TRANSPORT RING OF A BOTTLE

(71) Applicant: NOVEMBAL USA INC., Edison, NJ (US)

(72) Inventor: Richard Lamoureux, Rawdon (CA)

(73) Assignee: Novembal USA Inc., Edison, NJ (US)

( * ) Notice: Subject to any disclaimer, the term of this patent is extended or adjusted under 35 U.S.C. 154(b) by 0 days.

(21) Appl. No.: 17/268,119

(22) PCT Filed: Aug. 13, 2019

(86) PCT No.: PCT/US2019/046429
§ 371 (c)(1),
(2) Date: Feb. 12, 2021

(87) PCT Pub. No.: WO2020/037010
PCT Pub. Date: Feb. 20, 2020

(65) Prior Publication Data

US 2021/0323739 A1 Oct. 21, 2021

Related U.S. Application Data

(60) Provisional application No. 62/718,347, filed on Aug. 13, 2018.

(51) Int. Cl.
*B65D 55/16* (2006.01)
*B65D 1/02* (2006.01)
*B65D 41/34* (2006.01)

(52) U.S. Cl.
CPC ..... *B65D 55/16* (2013.01); *B65D 1/023* (2013.01); *B65D 41/3423* (2013.01)

(58) Field of Classification Search
CPC ... B65D 55/161; B65D 1/023; B65D 41/3423
USPC ..... 215/43, 306, 44; 220/375
See application file for complete search history.

(56) References Cited

U.S. PATENT DOCUMENTS

| | | | | |
|---|---|---|---|---|
| 4,054,221 | A | 10/1977 | Glover | |
| 4,394,918 | A | 7/1983 | Grussen | |
| 4,576,296 | A * | 3/1986 | Lecinski | B65D 41/08 215/274 |
| 5,398,837 | A | 3/1995 | Degrassi | |
| 8,443,994 | B1 * | 5/2013 | Desselle | B65D 55/16 215/306 |
| 8,469,213 | B2 * | 6/2013 | Ishii | B65D 55/16 215/252 |
| 9,415,906 | B2 * | 8/2016 | Kato | B65D 50/04 |
| 2006/0060554 | A1 * | 3/2006 | Garman | B29C 49/0073 215/43 |

(Continued)

OTHER PUBLICATIONS

International search report dated Sep. 21, 2019.

*Primary Examiner* — J. Gregory Pickett
*Assistant Examiner* — Niki M Eloshway

(57) ABSTRACT

The present invention discloses a tethered stopper affixed to a bottle neck finish. The stopper includes a closure shell, a tamper band, and a strip connecting the closure shell to the tamper band at the perimeter of both the closure shell and the tamper band. The bottle neck finish includes a transport ring having a retaining feature configured to receive and retain the strip of the stopper when the closure shell is removed from the bottle neck finish. Also discloses is a method for securing the tethered stopper within the tamper band.

12 Claims, 3 Drawing Sheets

(56) References Cited

U.S. PATENT DOCUMENTS

| | | | | |
|---|---|---|---|---|
| 2011/0297682 | A1* | 12/2011 | Kwon | B65D 41/34 220/268 |
| 2011/0309048 | A1* | 12/2011 | Briard | B29B 11/14 215/44 |
| 2014/0231376 | A1* | 8/2014 | Antier | B65D 41/0471 215/44 |
| 2015/0251827 | A1 | 9/2015 | Campbell | |
| 2015/0266631 | A1* | 9/2015 | Wohlgenannt | B65D 41/3428 215/44 |
| 2020/0369446 | A1* | 11/2020 | Melan-Moutet | B65D 41/3447 |

* cited by examiner

STRIP FOR SECURING A STOPPER TO A TRANSPORT RING OF A BOTTLE

TECHNICAL FIELD

This present disclosure relates generally to closures for containers. More specifically, the present disclosure relates to tethering closures that are configured to be retained by or locked onto a bottle transport ring.

BACKGROUND

In the field of liquid packaging, it is common to seal the aperture of a container with a stopper, often made from a plastic material. Such a container is usually a plastic bottle, but other materials may be used as well.

The stopper typically has a tubular shape closed at its top edge by a top wall. The stopper comprises a closure shell attached to a tamper band through the implementation of bridges. Bridges are distributed around the circumference of the closure shell and the tamper band. Moreover, the bridges may be made when molding the stopper or after through undergoing a cutting step during the manufacturing process.

Usually the bottle neck finish comprises outer fixation features, such as threads to receive a screw-type stopper. For screw type stoppers, the closure shell typically comprises inner thread(s) arranged on an inner side wall that are intended to engage with outer thread(s) located on the bottle neck finish. Such combinations of outer and inner thread(s) allow the stopper to be screwed on a bottle neck finish to seal it and unscrewed for bottle entirely opening.

Alternatively, the bottle neck finish comprises outer fixation features, such as annular fixation rings to receive a snap-type stopper that secures the stopper onto the bottle neck finish. A snap-type stopper includes an inner annular area and the bottle neck finish fixation feature includes an outer fixation ring, in order secure (e.g., using a downward force) the stopper onto the bottle neck finish. A snap type stopper comprises a closure shell with a movable sealing roof from a closure position to a part opening, and reversely. The roof may be separating upon opening or may be connected with the closure shell.

In a sealing position of the stopper, the tamper band is secured around the bottle neck finish through inner tamper band retaining features or through the tamper band diameter being smaller than a diameter of a tamper evident ring of the bottle neck finish.

The closure shell is typically removable. During bottle opening, the bridges form a weakness line and are torn apart from the closure shell, so it can be separated from the bottle. The weakness line is torn when user unscrews the closure shell of the stopper or when user lifts the roof by tilting.

After opening, the closure shell can be completely removed and discarded (e.g., dropped), preventing subsequent closure of the bottle. Additionally, the removed closure can represent waste if not recycled.

Previous solutions to prevent the closure shell from being completely removed from the bottle have been considered. For example, known systems include a tethered stopper comprising a spiral strip. The spiral strip is formed within stopper during the molding without subsequent operations (e.g., cutting or slitting).

One problem with respect to the spiral strip is that once the closure shell is separated from the bottle neck finish after opening, the elastic properties of the plastic strip cause the strip to attempt to return to original configuration around the neck finish. As the strip attempts to return to the original shape, the closure shell may interfere with the bottle aperture at the neck finish, which can cause the closure shell to interfere with the user during drinking or pouring.

SUMMARY

To prevent the closure being completely removed from a bottle while keeping the closure shell away from the bottle aperture, a solution consists of connecting the closure shell with the bottle, so the closure shell remains attached after the initial opening of the bottle and securing the closure shell so as to move the closure shell away from the bottle aperture.

An object of the present invention is a bottle tethered stopper, having a closure shell that remains attached to a tamper band which is secured on the neck of the bottle. Securing the closure shell to the tamper band after the initial opening, prevents a user from unintentionally misplacing or discarding the closure shell. Additionally, securing the closure shell to the tamper band, allows the user to secure and remove the closure shell from the bottle finish (e.g., threading) of the bottle multiple times, for example, during drinking.

Another object of the present invention is the bottle tethered stopper is configured to position the closure shell away from the bottle neck finish after initial and subsequent openings. Allowing the shell to be positioned away from the bottle neck finish after opening allows the user to position the closure shell away from the user during use (e.g., positioning shell away from user face during drinking).

According to the invention the tethered plastic stopper is affixed to a bottle neck finish, and the stopper comprises a closure shell, a tamper band, and a strip connecting the closure shell to the tamper band at the perimeter of both the closure shell and the tamper band. The bottle neck finish includes a transport ring comprising a retaining feature configured to receive and retain the strip of the stopper when the closure shell is removed from the bottle neck finish.

In some embodiments, the transport ring further comprising a plurality of retaining features positioned around the periphery of the transport ring. The retaining features can have a shape that is the same.

In some embodiments, the retaining feature includes a hollow area formed into the peripheral edge of the transport ring. In other embodiments, the hollow area is affixed onto the peripheral edge of the transport ring. In some embodiments, the hollow area is dimensioned relative to the strip thickness so that a part of the strip inserts into the hollow area.

In some embodiments, the stopper includes more than one strip connecting the closure shell to the tamper band after opening. In these embodiments, each strip is configured to be received and retained by at least one retaining feature when the closure shell is removed from the bottle neck finish.

The present invention can be practiced using a threaded closure shell or a flip top closure shell.

Also, according to the invention, a method for securing a stopper within the tamper band is included. The method includes providing the bottle that comprises a transport ring having a retaining feature. Secured onto the bottle is a stopper having a closure shell and a tamper band. The closure shell is separated from the tamper band, such that the closure shell remained connected to the tamper band by a strip secured to the perimeter of the shell closure and the tamper band. The strip is then positioned within the retaining feature of the transport ring. The strip remains secured within the retaining feature because the retaining feature is so dimensioned to receive and retain the strip of the stopper when the closure shell is removed from the bottle neck finish.

Other systems, methods, features, and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DESCRIPTION OF DRAWINGS

The figures are not necessarily to scale and some features may be exaggerated or minimized, such as to show details of particular components. Emphasis is placed on illustrating the principles of the invention. In the figures, like reference numerals designate corresponding parts throughout the different views.

DETAILED DESCRIPTION

As required, detailed embodiments of the present disclosure are disclosed herein. The disclosed embodiments are merely examples that may be embodied in various and alternative forms, and combinations thereof. As used herein, for example, exemplary, and similar terms, refer expansively to embodiments that serve as an illustration, specimen, model or pattern.

In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Phrasing such as 'configured to' perform a function, including in the claims, can include any or all of being sized, shaped, positioned in the arrangement, and comprising material to perform the function.

Terms indicating quantity, such as 'first' or 'second' are used for exemplary and explanation purposes and are not intended to dictate the specific ordering of a component with respect to other components.

Various embodiments of the present disclosure are disclosed herein. The described embodiments are merely exemplary illustrations of implementations set for a clear understanding of the principles of the disclosure. Variations, modifications, and combinations may be made to the described embodiments without departing from the scope of the claims. All such variations, modifications, and combinations are included herein by the scope of this disclosure and the claims.

Figure 1:
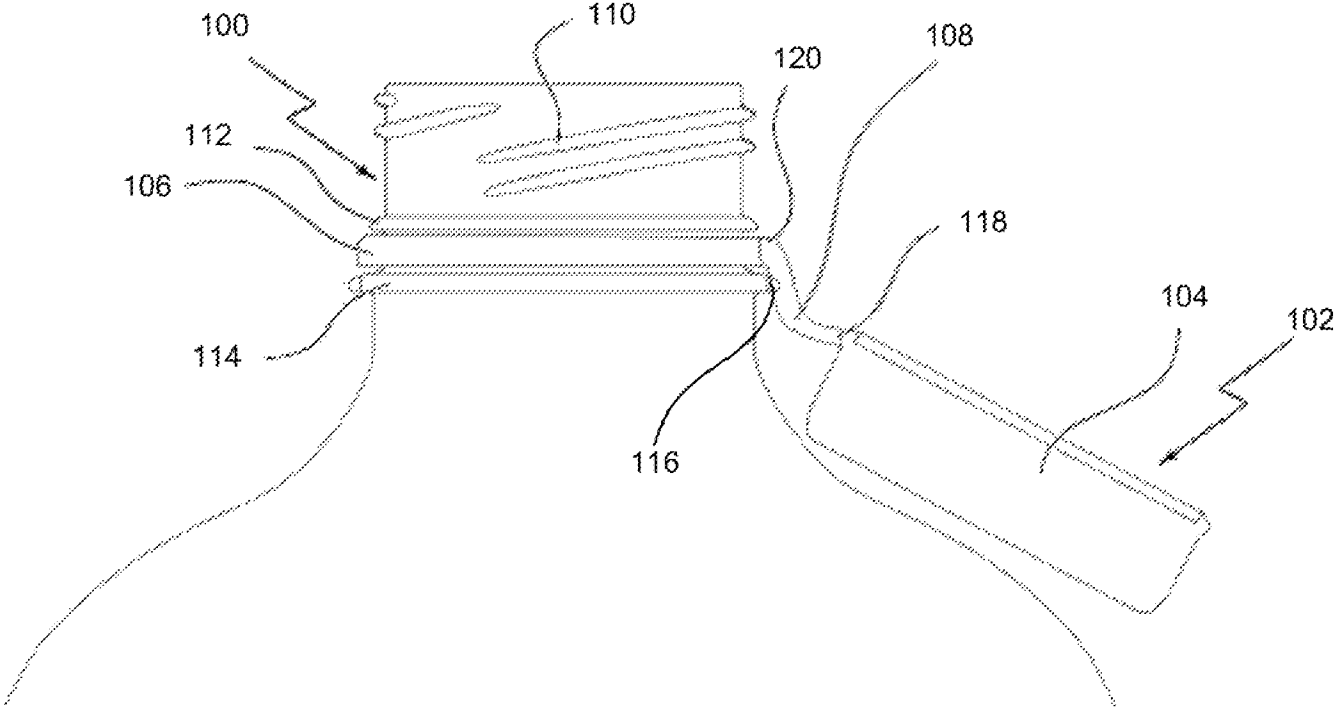
FIG. 1 illustrates a side view a tethered stopper locked on a transport ring of a bottle according to an embodiment of the invention.

FIG. 1 illustrates a screw stopper 102 in an open position relative to a bottle neck finish 100. The bottle neck finish 100 includes outer threads 110, an evident tamper ring 112, and a transport ring 114. The stopper 102 includes a closure shell 104 connected to a tamper band 106 using a strip 108.

In some embodiments, the bottle neck finish 100 includes engaging features (e.g., threads 110) meant to engage with complementary engaging features (not illustrated) located on the inner surface of the closure shell 104. In other embodiments, the bottle neck finish does not include engaging features (e.g., threads), and the closure shell 104 is secured onto the bottle neck finish 100 through other securing means, such as snaps, clasps, or other mechanically engaging features.

Before opening (e.g., during sealing), the stopper 102 is positioned (e.g., forced in a downward motion) onto the bottle neck finish 100 in such a way that the tamper band 106 is secured under the tamper evident ring 112 of the bottle neck finish 100. For example, the closure shell 104 is secured onto the bottle neck finish 110 by the outer threads 110 engaging with inner threads of the closure shell 104 as the tamper band 106 is positioned below the tamper evident ring 112. In some embodiments, the tamper band 106 comprises retaining features, such as an inner collar (not illustrated) to prevent the tamper band 106 from moving above the tamper evident ring.

During opening, a user to alters the position of the stopper 102, for example by twisting the closure shell 104 (where threads exist) or removing the closure shell 104 from a mechanically securing feature. As the bottle is opened, the strip 108 keeps the closure shell 104 connected to the tamper band 106. Specifically, the stopper 102 is not completely removed from the bottle because the strip 108 is attached at one end 118 to the closure shell 104 and at opposite end 120 to the tamper band 106, as illustrated in FIG. 1. In some embodiments, the strip 108 configured such that the closure shell 104 is positioned under the transport ring 114 thus avoiding the closure shell 104 from interfering with the user (e.g., drinking or pouring).

Because the closures shell 104 remains connected to the tamper band 106, the closure shell 104 can be positioned (e.g., by the user) to different locations around the bottle neck finish 100. For example, the tamper band 106 can rotate around the bottle neck finish 100, still secured under the tamper evident ring 112.

In the invention, the strip 108 is configured to be secured into a retaining feature 116 of the transport ring 114, thus allowing the closure shell 104 to remain attached to the tamper band 106 while the bottle is open. The transport ring 114 is necessary for blowing process to create a plastic bottle from a preform. The transport ring 114 extends outwardly around the shape of the bottle neck finish. In order to maintain the integrity of the transport ring 114 (e.g., for sealing during blow molding), the retaining feature 116 is incorporated at a peripheral edge transport ring 114.

The retaining feature 116 can be integrated into, formed within, and/or otherwise affixed to the transport ring 114. For example, the retaining feature 116 can be integrated into the transport ring 114 during an injection molding process. As another example, the retaining feature 116 can also be subsequently created within the transport ring 114, during a cutting or machining process after molding of the transport ring 114. As yet another example, the retaining feature 116 can be subsequently affixed to the transport ring 114 during a post manufacturing process.

In some embodiments, a portion of the strip 108 close to the end 118 attached to the closure shell 104 is configured to inserted into the retaining feature 116. In other embodiments, a portion of the strip 108 close to the end 120 attached to the tamper band 106 is configured to be inserted into the retaining feature 116.

In some embodiments, more than one retaining feature 116 is present within or subsequently attached to the transport ring 114. The retaining features 116 may be distributed, evenly or otherwise, about the perimeter of the transport ring 114.

Figure 2:
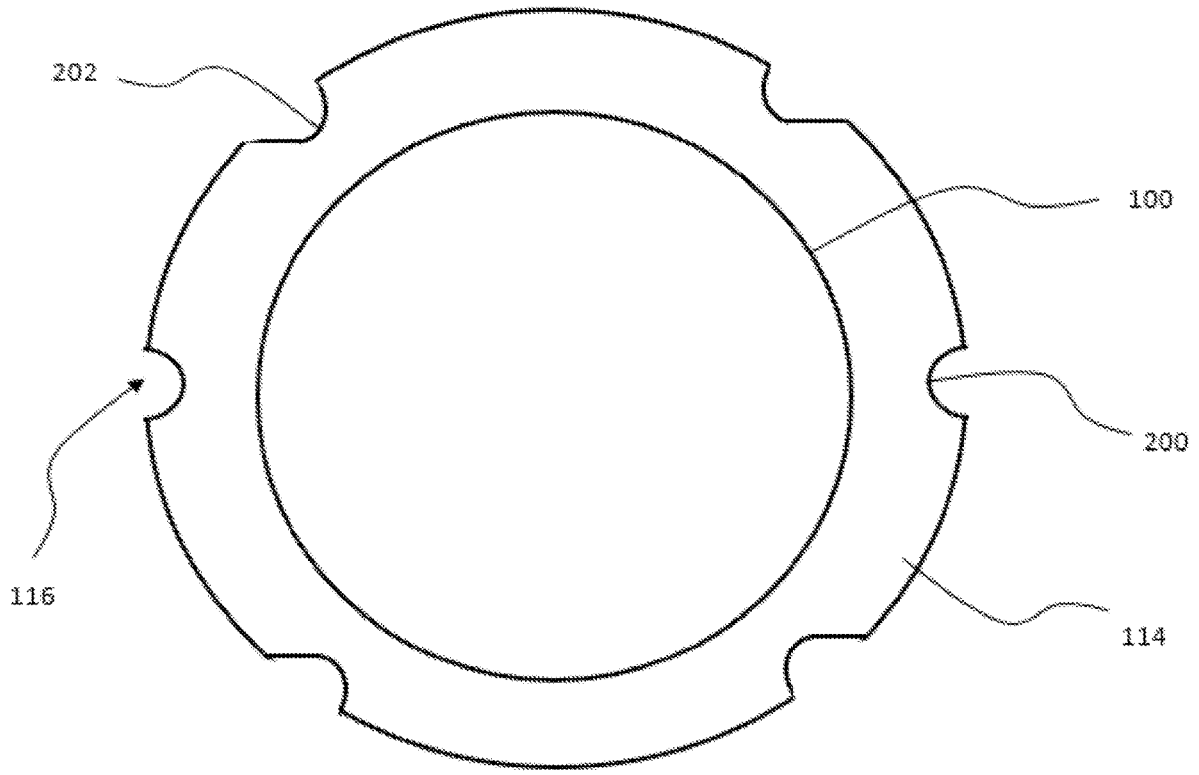
FIG. 2 illustrates a top view of a transport ring having multiple retaining features according to another embodiment of the invention.

As illustrated in FIG. 2, the retaining feature 116 comprises a hollow area 200 formed into the peripheral edge of the transport ring 114. Because the tamper band 106 allows the stopper 102 to turn around the bottle neck finish 100, the user can position the strip 108 into any available retaining feature 116. Specifically, the retaining feature 116 is configured (e.g., shaped) to receive the strip 108 after the opening of the bottle. In some embodiments, the strip 108 is locked into the retaining feature 116. For example, the user pushes the strip 108 inside the hollow area 200, in order to prevent the closure shell 104 to spring back close to the bottle neck finish 100.

Depending on whether the retaining feature 116 is intended to receive and lock the strip 108, the hollow area 200 is dimensioned relative to the thickness of the strip 108, so that at least a portion of the strip 108 that is inserted into the hollow area 200 can be retained by the hollow area 200 without additional effort of the user (i.e., the strip locks into the hollow area 200).

Figure 3:
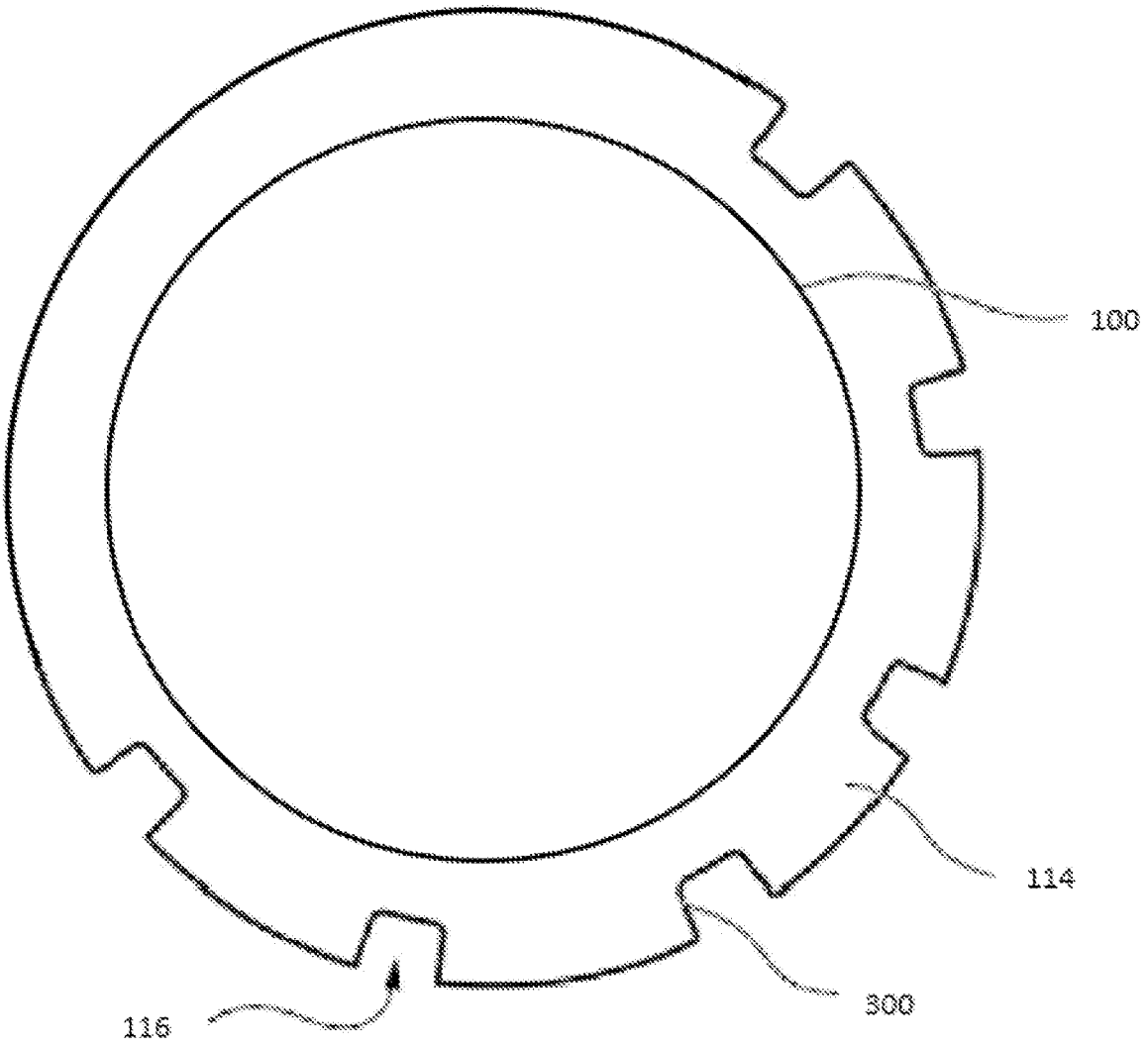
FIG. 3 illustrates a top view of a transport ring with stopper retaining features according to an alternative embodiment.

In some embodiments, the retaining features 116 are shaped the same. The shape can be any shape that allows the retaining feature 116 to receive and/or lock the strip 108. For example, the retaining feature 116 can be semicircular (as illustrated in FIG. 2). In the embodiment shown in FIG. 2, some of the hollow areas 200 have a semicircular shape, relative to the outer peripheral edge of the transport ring 114. In other embodiments, as illustrated in FIG. 3, hollow areas 300 are squared or polygonal in shape. Other geometric shapes or shape combinations can be used to form the hollow areas 200, 300 according to the characteristics (e.g., shape and thickness) of the strip 108, in order to improve the locking of the strip 108 into the hollow area 200 or 300.

In other embodiments, the retaining features 116 are shaped differently from one another. For example, some of the retaining features 116 illustrated in FIG. 2 are semicircular and other retaining features 116 contain both semicircular and linear components (e.g., hollow area 202). The retaining features 116 can be shaped differently, for example, to accommodate receiving the strip 108 at a position that is not perpendicular to the transport ring 114. Additionally, or alternatively, manufacturing processes may create retaining feature(s) 116 having different shapes. For example, a cutting process may create retaining features 116 that are shaped differently depending on factors such as the position of the blade.

In some embodiments, the stopper 102 includes more than one strip 108. Where the stopper 102 includes multiple strips 108, it is possible to lock each strip 108 into a different retaining feature 116.

While various embodiments of the invention have been described, it will be apparent to those of ordinary skill in the art that many more embodiments and implementations are possible that are within the scope of this invention.

What is claimed is:

1. A plastic bottle having an aperture, comprising:

a tubular shaped bottle neck finish comprising tamper evident ring and a transport ring positioned beneath the tamper evident ring; and a tethered stopper comprising a closure shell, a tamper band, and a curved strip having a thickness defined by a lateral width and configured to be received by the transport ring, the curved strip being connected at one end to the closure shell and an opposite end to the tamper band, wherein the tamper band of the stopper being secured under the tamper evident ring, and the transport ring comprising a retaining feature configured to receive and retain the thickness of the curved strip of the stopper when the closure shell is removed from the aperture.

2. The plastic bottle according to claim 1, the transport ring further comprising a plurality of retaining features positioned around the periphery of the transport ring.

3. The plastic bottle according to claim 1, wherein the retaining feature further comprises a hollow area formed into the peripheral edge of the transport ring.

4. The plastic bottle according to claim 3, wherein the hollow area is dimensioned relative to the curved strip thickness so that a part of the curved strip inserts into the hollow area.

5. The plastic bottle according to claim 1, wherein the retaining feature further comprises a hollow area affixed onto the peripheral edge of the transport ring.

6. The plastic bottle according to claim 5, wherein the hollow area is dimensioned relative to the curved strip thickness so that a part of the curved strip inserts into the hollow area.

7. The plastic bottle according to claim 1, the bottle neck finish further comprising an outer thread and the closure shell comprises a corresponding inner thread.

8. The plastic bottle according to claim 1, wherein at least two of the retaining features have a shape that is the same.

9. The plastic bottle according to claim 1, further comprises a second strip connecting the closure shell to the tamper band, wherein a second retaining feature is configured to receive and retain the second strip when the closure shell is removed from the aperture.

10. A method for securing a stopper onto a bottle neck finish comprising a closure shell and a tamper band to a transport ring of plastic bottle having a neck finish and an aperture, the method comprising:

providing the bottle that comprises a transport ring having a retaining feature;

separating a portion of the closure shell from the tamper band, wherein the closure shell remains connected to the tamper band by a curved strip therebetween, the curved strip being secured at one end to the perimeter of the shell closure and at an opposite end to the tamper band, wherein the curved strip has a thickness defined by a lateral width; and positioning the curved strip within the retaining feature of the transport ring, wherein the retaining feature is so dimensioned to receive and retain the thickness of the curved strip of the stopper when the closure shell is removed from the bottle neck finish.

11. The method according to claim 10 wherein the bottle neck finish further comprises an outer thread and the closure shell comprises a corresponding inner thread.

12. The method according to claim 11, wherein the separating occurs by unscrewing the closure shell such that the outer thread and inner thread disengage.

* * * * *